US005815927A

United States Patent [19]

Collins

[11] Patent Number: 5,815,927

[45] Date of Patent: Oct. 6, 1998

[54] FOLDING KNIFE WITH ACTUATABLE SAFETY LOCKING MECHANISM

[76] Inventor: Walter W. Collins, P.O. Box 100, 4651 Savannah Hwy., North, S.C. 29112

[21] Appl. No.: 583,822

[22] Filed: Jan. 11, 1996

[51] Int. Cl.[6] ..... B26B 1/04

[52] U.S. Cl. ..... 30/161; 30/155; 30/159

[58] Field of Search ..... 30/155, 156, 157, 30/158, 159, 160, 161, 331

[56] References Cited

U.S. PATENT DOCUMENTS

| | | | |
|---|---|---|---|
| D. 336,602 | 6/1993 | Thompson et al. | D8/99 |
| 616,689 | 12/1898 | Ruettgers | 30/158 |
| 1,603,914 | 10/1926 | Hermann | 30/159 X |
| 1,701,027 | 2/1929 | Brown | 30/159 |
| 2,407,897 | 9/1946 | Newman | 30/159 |
| 3,868,774 | 3/1975 | Miori | 30/161 |
| 4,451,982 | 6/1984 | Collins | 30/161 |
| 4,604,803 | 8/1986 | Sawby | 30/161 |
| 4,612,706 | 9/1986 | Yunes | 30/160 |
| 4,802,279 | 2/1989 | Rowe | 30/155 |
| 5,095,624 | 3/1992 | Ennis | 30/161 |
| 5,111,581 | 5/1992 | Collins | 30/161 |
| 5,131,149 | 7/1992 | Thompson et al. | 30/161 |

FOREIGN PATENT DOCUMENTS

| | | | |
|---|---|---|---|
| 435488 | 3/1912 | France | 30/159 |
| 493741 | 8/1919 | France | 30/159 |
| 1069862 | 7/1954 | France | 30/159 |
| 1171740 | 1/1959 | France | 30/159 |
| 28765 | 10/1884 | Germany | 30/159 |
| 29469 | 11/1884 | Germany . | |

*Primary Examiner*—Clark F. Dexter

*Attorney, Agent, or Firm*—Leatherwood Walker Todd & Mann, P.C.

[57] ABSTRACT

A folding knife having a blade pivot connecting a blade to a handle for pivotal movement between an extended position outside of the blade cavity and a retracted position substantially within the blade cavity. A spring biased plunger having a first end and second end opposite the first end is provided, and the first end of the plunger includes a pivotal connector pivotally connecting the plunger to the handle within the blade cavity. The second end of the plunger is pivotally connected to the blade for orbital movement about the blade pivot as the blade moves between the retracted and extended positions. A pivotable locking member is connected to the handle for selectively locking the blade in the extended position. Further, an engagement portion is provided for opening the blade using a downward motion.

11 Claims, 5 Drawing Sheets

FOLDING KNIFE WITH ACTUATABLE SAFETY LOCKING MECHANISM

BACKGROUND OF THE INVENTION

This invention relates generally to a folding knife for general use having an actuatable safety mechanism which allows the blade of the knife to be selectively locked or unlocked in an open position.

Folding knives are a popular means for allowing a blade to be conveniently carried in a user's pocket, toolbox, tackle box, glove compartment, backpack, etc. Folding knives are sometimes provided with a blade which may be locked in an open position and then unlocked manually when the blade is to be closed back into the knife's handle. Folding knives with blades which automatically lock are desirable for safety purposes in that the blade is prevented from closing on the user's hand or fingers during use. However, there may be times when it is not desirable to have the blade locked in the open position, for example, when using the blade for simply opening a letter or cutting a piece of string or tape. In such situations, closure of the blade would not require the separate deactivation of a blade locking member, which may be the case had the blade been locked.

Various folding knives have been patented having blade locking configurations. For example, U.S. Pat. No. 3,868,774, issued to Miori, discloses a knife having a sliding locking member for selectively locking the blade in an open or closed position. U.S. Pat. No. 5,111,581, issued to Collins (the present applicant) , discloses a folding knife having a strut pivoting between a transfer bar and the handle for enhancing locking of the blade. U.S. Pat. No. 4,451,982, also issued to Collins, discloses a folding knife having a spring-biased bolt locking mechanism. U.S. Pat. No. 5,095,624, issued to Ennis, discloses a lock system for a folding knife having a spring-biased toggle mechanism. U.S. Pat. No. 4,802,279, issued to Rowe, discloses a game hunting knife having a blade with an enlarged knurled portion.

While the foregoing designs are known, there still exists a need for a folding knife having a selectable safety mechanism for locking and unlocking a blade.

As there may be certain times when a user would desire to lock the blade in the open position, and there may be other times when the user would prefer to have the blade in an unlocked open position, a need exists for providing a mechanism which selectively allows the user to choose whether to lock or unlock the blade in an extended position.

Additionally, it would be desirable to provide a folding knife having means for allowing the user to readily open the blade, even when the user is wearing gloves or in situations where the user's hand is disabled to an extent which limits the mobility of the user's fingers in grasping and extracting a conventional blade from a folding knife.

SUMMARY OF THE INVENTION

It is, therefore, the principal object of this invention to provide a folding knife having a selectively actuatable safety mechanism for allowing the user to lock the blade of a folding knife in an extended position.

It is another object of the present invention to provide a folding knife having means for allowing the blade to be readily opened and extended by persons having limited hand mobility.

It is a further object of the present invention to provide a folding knife having spring-biased means for retaining a blade of a folding knife in a closed position.

It is a still further object of the present invention to provide a method of operating a folding knife constructed in accordance with the present invention.

Generally, the present invention includes a folding knife having a handle defining a blade cavity. A blade is provided having a first end and a second end opposite the first end. The first end of the blade has a blade pivot for allowing pivotal movement of the blade about the blade pivot between an extended position outside of the blade cavity and a retracted position substantially within the blade cavity. A plunger having a first end and second end opposite the first end is provided, and the first end of the plunger includes a pivotal connector pivotally connecting the plunger to the handle within the blade cavity. The second end of the plunger is pivotally connected to the first end of the blade for orbital movement about the blade pivot as the blade moves between the retracted and extended position. A biasing means is connected to the plunger for biasing the plunger outwardly towards the first end of the blade.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
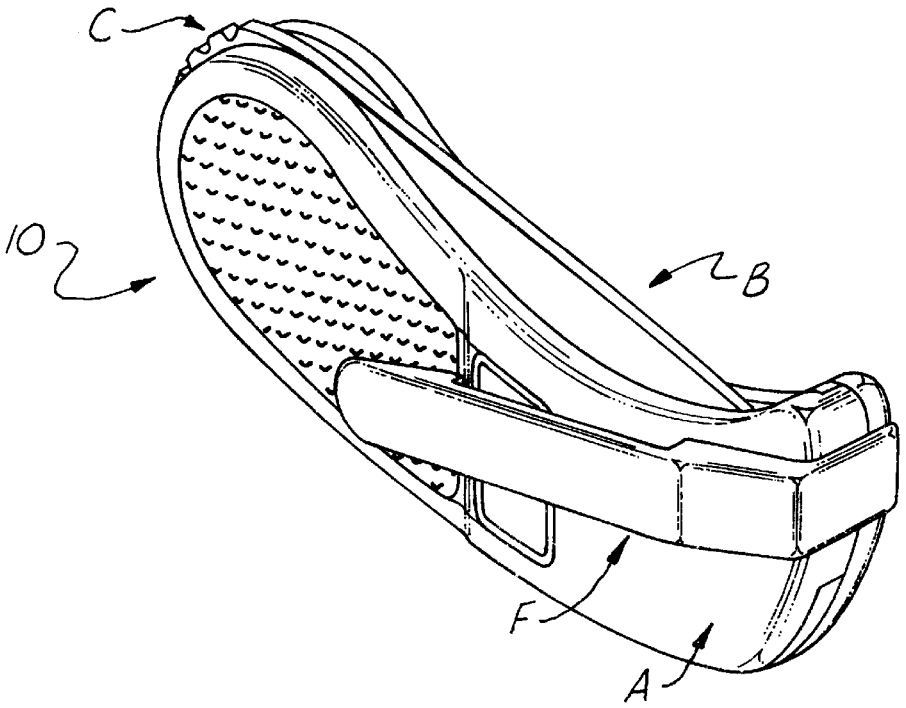
FIG. 1 is a perspective view of a folding knife constructed in accordance with the present invention.

The accompanying drawings and the description which follows set forth this invention in its preferred embodiment. However, it is contemplated that persons generally familiar with knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the knife of the present invention is indicated generally in the figures by reference character 10.

Figure 2:
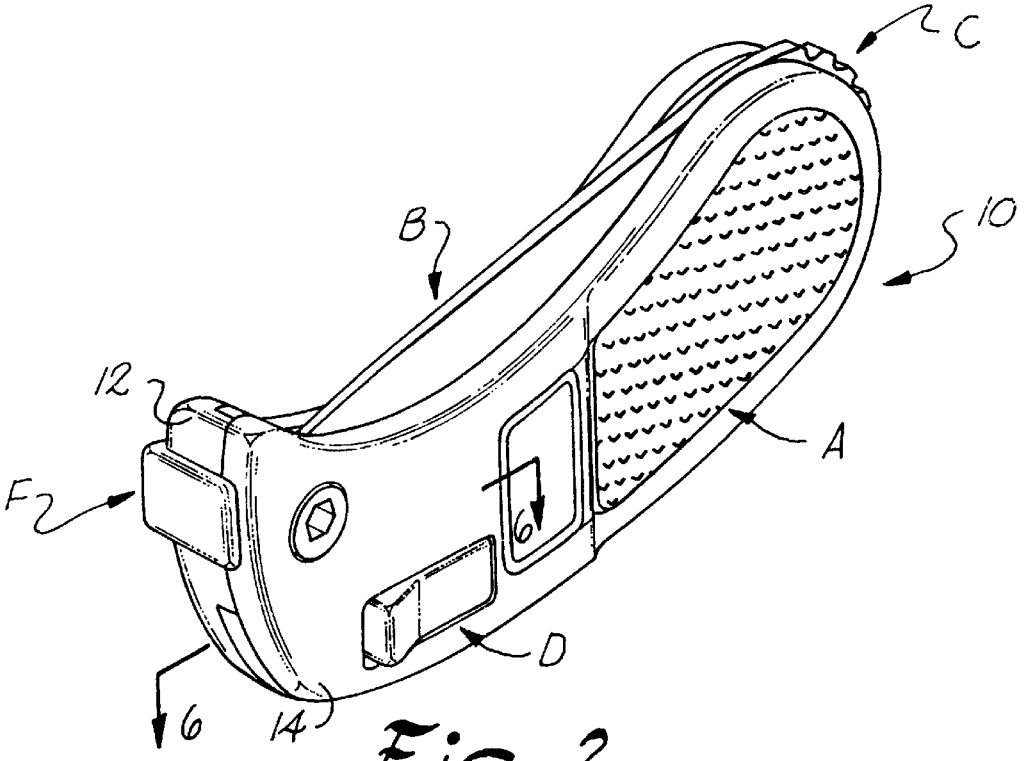
FIG. 2 is a perspective view of the reverse side of the knife illustrated in FIG. 2.
Figure 3:
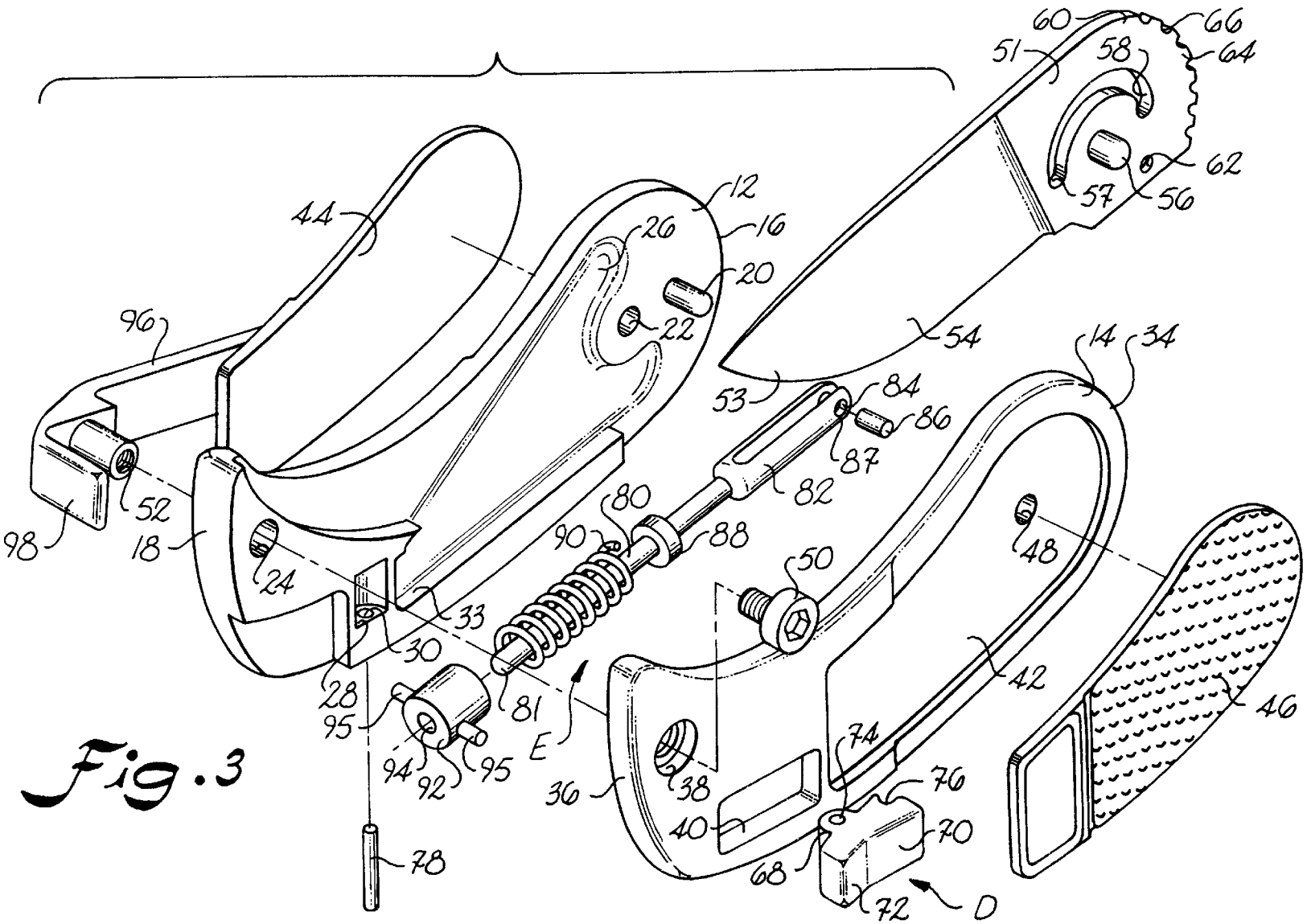
FIG. 3 is an exploded of a knife constructed in accordance with the present invention.

FIGS. 1 and 2 illustrate both sides of a folding knife 10 constructed in accordance with the present invention. Folding knife 10 includes a handle portion, generally A, a blade portion, generally B, a blade engagement portion, generally C, a locking member, generally D, a plunger mechanism, generally E (as shown in FIG. 3), and a belt clip, generally F.

Turning now to a further description of those major components A through F, handle A includes two elongated handle portions 12, 14. Handle portions 12, 14 are preferably constructed of glass-filled nylon, however, any other suitable material could also be used, such as metal, plastic, bone, or other suitable material. Handle members 12, 14, when connected to one another, form a blade cavity, generally 15, therebetween for carrying blade B. Handle portion 12 includes a first end 16 and an opposite end 18. Carried within end 16 is a pin 20, the purpose of which will be described later. Hole 22 is defined in handle portion 12 for receipt of a pin 56 about which blade B pivots. A blade recess 26 is defined in handle portion 12 and serves to form part of blade cavity 15 when handle portions 12, 14 are assembled together. The blade cavity 15 also includes a recess 28 provided in handle portion 12 for receipt of a portion of locking member D. Additionally, a hole 24 is provided in the handle portion 12 for attachment of clip F. Also provided in handle portion 12 is a recess 33 for receipt of a portion of plunger assembly E.

Handle portion 14 includes a first end 34, and an opposite end 36. A hole 38 is provided for allowing attachment of clip F, and a slot 40 is provided for receipt of locking member D. Panel recess 42 is provided in handle portion 14 for receipt of a cover panel 46 upon assembly of knife 10. When handle members 12, 14 are assembled together with blade B therebetween, panel 46 may be inserted into recess 42 either by adhesive, press fit, or some other attachment means to provide a cushioned and checkered gripping surface for knife 10, and also, as illustrated in the Figures, for covering blade pin 56, thereby concealing pin 56 from view, if desired. It is to be understood, however, that panel 46 could be provided with a hole (not shown) for receipt of blade pin 56, if desired. A panel 44 is likewise provided for handle portion 12, which is also received in a corresponding recess (not shown) similar to recess 42.

A hole 48 is also provided in handle portion 14 for receipt of pin 56 of blade B. As illustrated in FIG. 3, screw 50 is provided for attachment of clip F through engagement with threaded boss 52 of clip F. It is to be understood that clip F can be connected to knife 10 such that it is adjacent either handle portion 12 or handle portion 14, as desired.

Blade B includes a first end portion 51 and a second, tipped portion 53 substantially opposite first end 51. A sharpened cutting edge 54 is also provided on blade B. First end 51 of the blade includes pivot pin 56, discussed above, as well an arcuate slot 58 which receives pin 20 provided in handle portion 12. Engagement of pin 20 with slot end 57 acts as a limiting stop to prevent overextension of the blade with respect to the handle A. The other end of slot 58 also provides a limit against over-retraction of the blade within the blade cavity of handle A. First end 51 includes an extension portion 60 having an extreme end 64 of a generally curved profile with a plurality of upstanding ridges 66 provided thereon. Briefly, ridges 66 allow for the user to gain purchase on the end of the blade, and through engagement of the ridges and through a pulling down motion, as illustrated in the Figures, blade B will be caused to pivot about pin 56 and ultimately be moved to an extended position, such as that illustrated in FIGS. 4C and 5C.

Figure 5A:
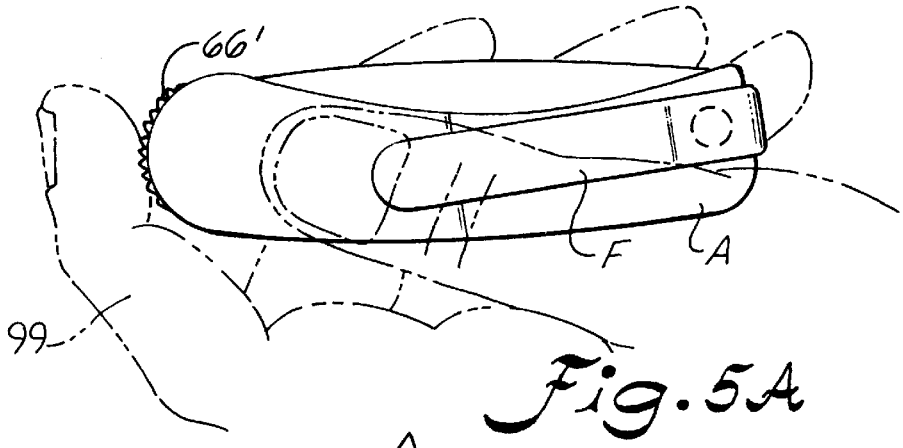
FIG. 5A is a side elevational view of an alternate embodiment of a folding knife constructed in accordance with the present invention, showing the blade in a retracted state.
Figure 5B:
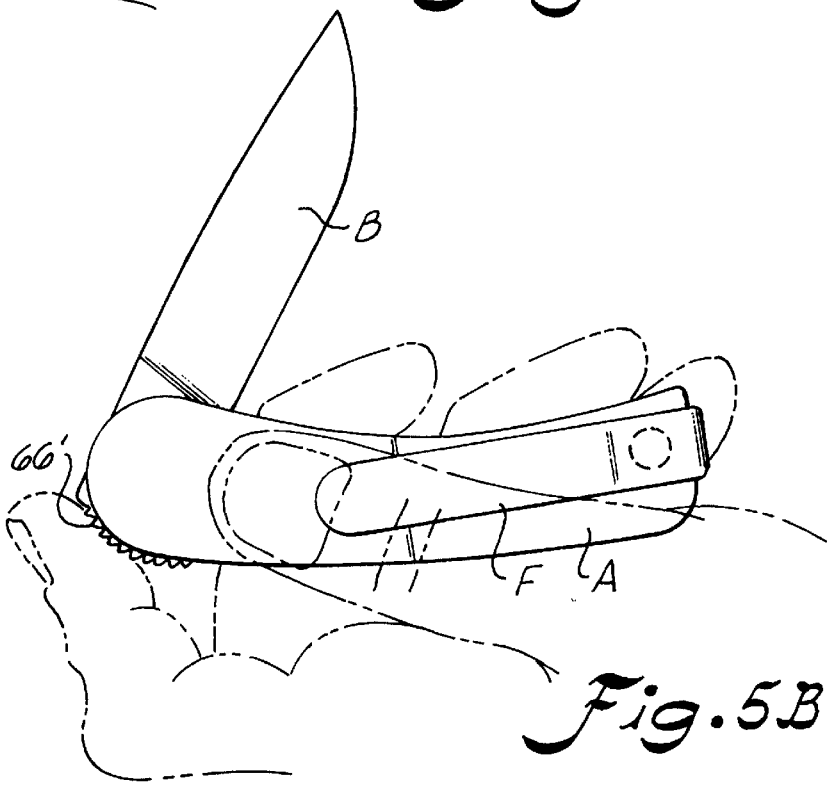
FIG. 5B is a side elevational view of the knife illustrated in FIG. 5A with the blade in an intermediate position.

Engagement profile C is not limited to the ridges 66 indicated in the Figures, but could include a variety of profiles, and may in one preferred embodiment include a saw-toothed-like profile 66', as illustrated in FIGS. 5A and 5B, wherein the saw-toothed ridges 66' are angled in a direction opposite to the direction in which blade B moves from the retracted position to the extended position.

Figure 6:
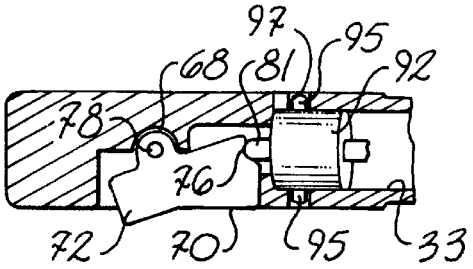
FIG. 6 is a sectional view taken along lines 6—6 of FIG. 2, and shows a safety locking member in a locked position.
Figure 7:
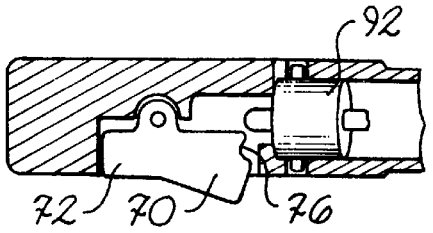
FIG. 7 is a view similar to that of FIG. 6, showing the safety lock mechanism in an unlocked position.

Turning now to locking member D as illustrated in FIG. 3, locking member D includes a sleeve portion 68 having button portions 70, 72 on the exterior thereof. A hole 74 is provided extending through sleeve 68, which receives pin 78. Pin 78 is received within holes 30 (only one of which is shown) within locking member recess 28 of handle portion 12. Locking member D pivots about pin 78 between a locking position, as illustrated in FIG. 6, and an unlocking position, as illustrated in FIG. 7. When pivoted to a locking position, brought about by depression of button portion 70, a plunger end recess 76 provided on locking member D receives a portion of plunger assembly E, which, in turn, and as set forth below, maintains blade B in the extended position. When push button portion 72 is depressed, plunger engagement recess 76 moves outwardly to become disengaged with the plunger, to thereby unlock blade B and to allow blade B to be manually moved to its retracted position, indicated in FIGS. 1, 2, 4A, and 5A.

Plunger assembly E is best illustrated in FIG. 3 and includes an elongated shaft 80 having a free end 81. Shaft 80 is provided with a yoke, or clevis 82, having holes 84 provided therein for receipt of a clevis pin 86. A collar 88 is provided on shaft 80 against which a coil spring 90 bears upon assembly of the plunger system E. Coil spring 90 also bears against a sleeve, or collar, 92, while free end 81 of shaft 80 is received for rectilinear movement within a passage 94 of collar 92. Pins 95 are provided on collar 92 and are diametrically opposed from one another. Pins 95 are received within openings 97 provided in handle portions 12, 14, respectively, to allow pivoting of collar 92 within passage 33 and the blade cavity portion of handle A.

Clevis pin 86 is received within hole 62 of blade B upon assembly of knife 10. Since pin 86 is at a fixed distance from pivot pin 56 as the blade pivots between the retracted and extended positions, pin 86, and accordingly, end 87, of clevis 82 moves through a corresponding arc, the radius of the arc being the distance between the centers of holes 84 of clevis 82 and pin 62 of blade B. Thus, as blade B moves between the retracted and extended positions, end 87 of clevis 82 tends to "orbit" about pivot pin 56.

Plunger assembly E has as its primary purpose the retention of blade B in the retracted state, in order to prevent the blade from falling or "flopping" out of handle A during nonuse periods. Plunger assembly E, due to its eccentric connection to blade B, provides for a smooth opening action of the blade with respect to the handle, and also assists in maintaining the blade in the extended position, once the blade is at such position. The plunger assembly E does not lock the blade in the extended position, but does hold the blade sufficiently in that position so that the blade may be used. For locking of the blade in the extended position, button portion 70 of the "safety", or locking member, D is depressed in order to allow engagement of recess 76 with free end 81 of shaft 80.

Because of the engagement profile C provided on blade B, the user may hold knife 10 in his or her hand, with the blade cavity facing upwardly, and open the blade with the thumb or forefinger. Because only a limited range of motion is required by the user with the thumb or forefinger in order to open the blade, the present design facilitates use of knife 10 when the user is wearing gloves, or if the user has limited mobility of his or her fingers. Engagement profile C allows for relatively straightforward opening of blade B by the user with one hand, if desired. Once the blade is in the extended position, it can either be used in a "safe" configuration, wherein safety D is depressed, or simply left unlocked. In order to retract the blade, the safety must first be disengaged. This reduces the likelihood of inadvertent closure of the knife, which could cause injury.

Figure 4A:
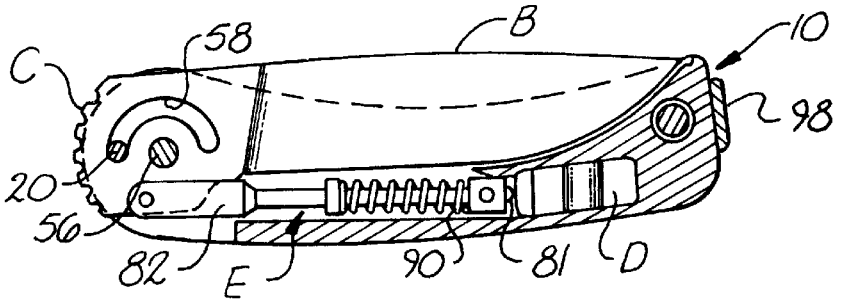
FIG. 4A is a sectional view of a knife constructed in accordance with the present invention with the blade in a retracted position.
Figure 4B:
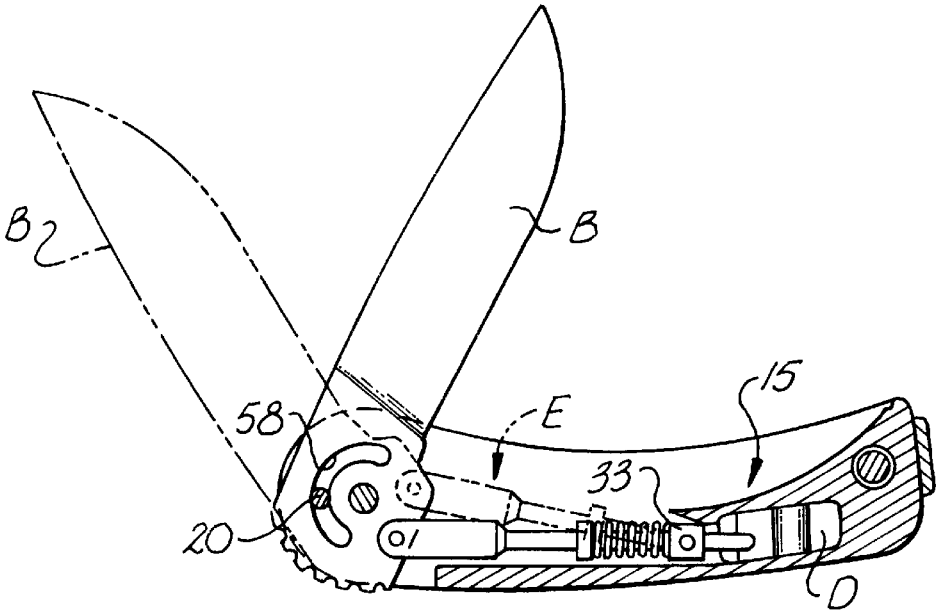
FIG. 4B is a sectional view of a folding knife constructed in accordance with the present invention with the blade in an intermediate position.
Figure 4C:
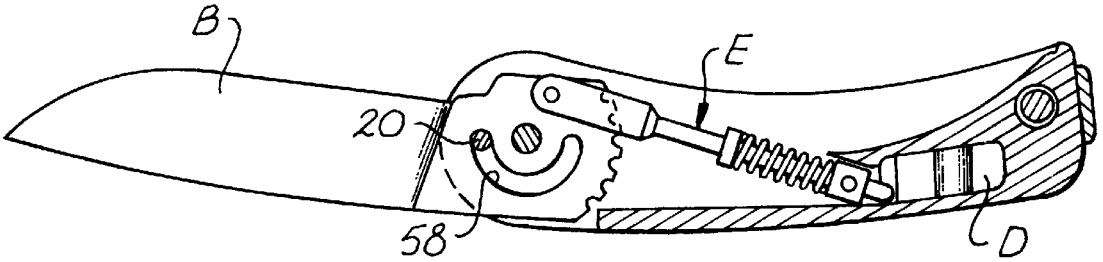
FIG. 4C is a sectional view of a folding knife constructed in accordance with the present invention with the blade in an extended position.

FIGS. 4A through 4C illustrate movement of blade B between the retracted position, as shown in FIG. 4A, and the extended position, as shown in FIG. 4C, in which the blade has pivoted approximately 180 degrees from said retracted position. During movement of the blade between those two positions, it can be seen that plunger assembly E pivots about pins 95 of collar 92. It can also be seen that spring 90 is at various states of compression as blade B moves between the retracted and extended positions.

Figure 5C:
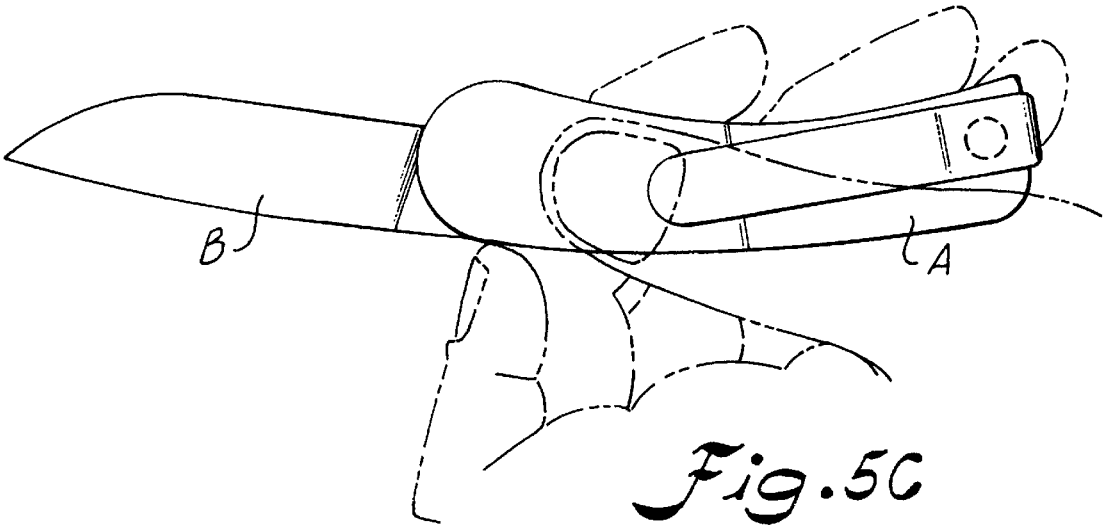
FIG. 5C is a side elevational view of the knife illustrated in FIGS. 5A and 5B, with the blade in an extended state.

FIGS. 5A through 5C illustrate an alternate engagement profile 66' which includes directional saw-like teeth, which are oriented to maximize purchase, or engagement, of the user's finger 99 with profile 66' in order to open blade B.

Figure 8A:
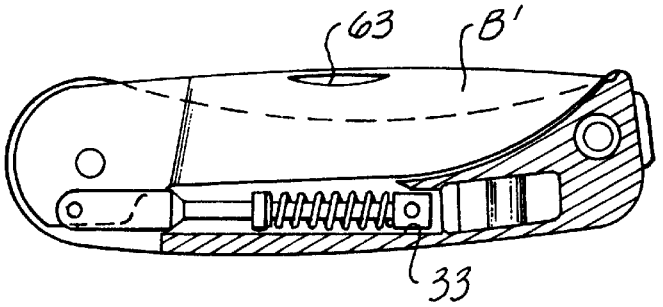
FIG. 8A is a sectional view of a knife constructed in accordance with the present invention illustrating an alternate embodiment blade opening element.

FIG. 8A illustrates an alternate embodiment blade B'. Blade B' is not provided with an engagement profile such as discussed above, but instead is provided with a conventional nail mark 63 for use in opening blade B.

Figure 8B:
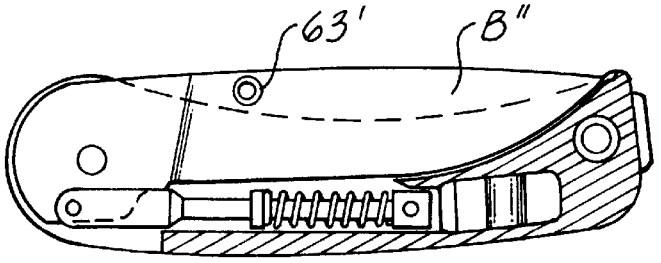
FIG. 8B is a sectional view of a knife constructed in accordance with the present invention showing a further alternate embodiment blade opening element.

FIG. 8B illustrates a further alternate embodiment of the present invention, wherein blade B" does not include an engagement profile, but instead, includes a pin 63' rotatably connected to an upper portion of blade B". The user could engage such pin 63' with his or her thumb or finger to open blade B".

Clip F is provided on knife 10 and can be used as a clip for clipping the knife to the user's boot, belt, pocket, strap, backpack, etc. Clip F includes an elongated clipping member 96 and at one end thereof and a stabilizer 98, which engages the end of the knife handle A, for preventing rotation of clip F about screw 50 during use. As discussed above, clip F can be attached to either side of handle A, using screw 50, as desired.

Knife 10 provides an easy-to-open folding blade and also provides the option to the user of either securing the blade in an extended position, or leaving the blade unlocked. Once locked, the safety button D must be first depressed in order to allow movement of the blade to its retracted position. Further, engagement profile C of knife 10 facilitates opening of the blade by users having limited hand mobility brought about either through a physical disability or through the wearing of gloves, mittens, or the like.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A folding knife, comprising:

a handle defining a blade cavity and a first end;

a blade having a first end and a second end opposite said first end; said first end of said blade having a blade pivot connected to said first end of said handle for pivotal movement of said blade about said blade pivot between an extended position wherein the blade is outside of said blade cavity and a retracted position wherein the blade is substantially within said blade cavity;

a longitudinally extending plunger carried in said blade cavity having a first end and second end opposite said first end;

a pivotal connector pivotally connected to said handle for pivotally connecting said plunger to said handle, said first end of said plunger being longitudinally slidably carried by said pivotal connector for longitudinal movement of said plunger relative to said pivotal connector as said blade moves between said retracted and extended positions; and said second end of said plunger being pivotally connected to said first end of said blade for orbital movement about said blade pivot as said blade moves between said retracted and extended positions.

2. A folding knife as defined in claim 1, wherein said blade includes said first end of said blade having an extension projecting outwardly from said handle when said blade is in said retracted position; said extension defining an extreme edge portion with a plurality of ridges thereon for contact by a user when moving the blade from said retracted position to said extended position.

3. A folding knife as defined in claim 2, wherein said plurality of ridges are generally saw-tooth-shaped and are generally angled in a direction substantially opposite to the direction said second end of said blade moves when moving from said retracted position to said extended position.

4. A knife as set forth in claim 1, further comprising a safety member pivotally connected to said handle for movement between a locking position and an unlocking position; said safety member defining an engagement portion projecting into said blade cavity and in the path of movement of said first end of the plunger when said safety member is in said locking position for contacting and restraining movement of said first end of said plunger when said blade is in said extended position, to thereby lock said blade in said extended position.

5. A knife as defined in claim 1, further comprising said handle defining a first side and a second side opposite said first side and a belt clip connected to said handle adjacent one of said first and second sides of said handle.

6. A knife as defined in claim 1, wherein said pivotal connector includes a sleeve having a passageway, and wherein said first end of said plunger extends through said passageway such that said first end of said plunger moves substantially rectilinearly in said passageway during said longitudinal movement of said plunger as said blade is moved between said retracted and extended positions.

7. A folding knife as defined in claim 1, wherein said pivotal connector is a sleeve having diametrically opposed pivot pins attached thereto, said pivot pins pivotally connecting said pivotal connector within said handle.

8. A folding knife as set forth in claim 1, wherein said second end of said plunger includes a clevis having a pin pivotally connected to said first end of said blade.

9. A folding knife as defined in claim 1, wherein said first end of said blade includes an arcuate slot and wherein said handle includes a pin carried in said arcuate slot, said arcuate slot having a first end and a second end, and said first end of said arcuate slot limiting said blade from movement beyond said extended position.

10. A knife as defined in claim 1, further comprising a coil spring encircling said plunger.

11. A folding knife, comprising:

a handle defining a blade cavity and a first end;

a blade having a first end and a second end opposite said first end; said first end of said blade having a blade pivot connected to said first end of said handle for pivotal movement of said blade about said blade pivot between an extended position wherein the blade is outside of said blade cavity and a retracted position wherein the blade is substantially within said blade cavity;

a spring longitudinally extending plunger carried in said blade cavity having a first end and second end opposite said first end;

a sleeve provided in said handle, said sleeve receiving and longitudinally slidably carrying said first end of said plunger for longitudinal movement of said plunger relative to said sleeve as said blade moves between said retracted and extended positions; and said second end of said plunger being pivotally connected to said first end of said blade for orbital movement about said blade pivot as said blade moves between said retracted and extended positions.

* * * * *

UNITED STATES PATENT AND TRADEMARK OFFICE

CERTIFICATE OF CORRECTION

PATENT NO : 5,815,927

DATED : October 6, 1998

INVENTOR(S): Walter W. Collins

It is certified that error appears in the above-identified patent and that said Letters Patent is hereby corrected as shown below:

Claim 11, Column 8, Line 4 -- delete "spring"

Signed and Sealed this

Twenty-ninth Day of December, 1998

*Attest:*

Bruce Lehman

BRUCE LEHMAN

*Attesting Officer*

*Commissioner of Patents and Trademarks*